US005105486A

United States Patent [19]

Peterson

[11] Patent Number: 5,105,486

[45] Date of Patent: Apr. 21, 1992

[54] ADJUSTABLE BED

[75] Inventor: Warren J. Peterson, Stevens Point, Wis.

[73] Assignee: Joerns Healthcare Inc., Stevens Point, Wis.

[21] Appl. No.: 540,282

[22] Filed: Jun. 18, 1990

[51] Int. Cl.[5] ..... A61G 7/00

[52] U.S. Cl. ..... 5/611; 5/614; 5/618

[58] Field of Search ..... 5/60, 62, 63, 66–69, 5/80

[56] References Cited

U.S. PATENT DOCUMENTS

| | | | |
|---|---|---|---|
| 1,329,611 | 2/1920 | Koenigkramer . | |
| 1,417,675 | 5/1922 | McManis . | |
| 1,448,477 | 3/1923 | Williams . | |
| 2,124,602 | 7/1938 | Bardaji . | |
| 2,194,998 | 3/1940 | Christensen . | |
| 2,381,922 | 8/1945 | Norris . | |
| 2,445,258 | 7/1948 | Beem . | |
| 2,601,686 | 7/1952 | Roessler . | |
| 2,617,118 | 11/1952 | Lorenz . | |
| 2,917,753 | 12/1959 | Portis et al. . | |
| 3,003,160 | 10/1961 | Goodman . | |
| 3,105,247 | 10/1963 | Katz . | |
| 3,127,783 | 4/1964 | Martens | 5/66 |
| 3,132,515 | 5/1964 | Huntress et al. . | |
| 3,209,747 | 10/1965 | Guentner . | |
| 3,220,020 | 11/1965 | Nelson . | |
| 3,230,554 | 1/1966 | Peterson . | |
| 3,353,193 | 11/1967 | Greiner . | |
| 3,530,514 | 9/1970 | McCalley . | |
| 3,535,716 | 10/1970 | Greiner | 5/66 |
| 3,681,792 | 8/1972 | Korber . | |
| 3,733,623 | 5/1973 | Croxton . | |
| 3,742,527 | 7/1973 | Johnston et al. . | |
| 3,877,088 | 4/1975 | Bouman . | |
| 3,916,461 | 11/1975 | Kerstholt | 5/66 |
| 4,100,630 | 7/1978 | Klose et al. . | |
| 4,107,797 | 8/1978 | Maxwell . | |
| 4,231,124 | 11/1980 | Croxton | 5/62 X |
| 4,236,261 | 12/1980 | Huempfner . | |
| 4,251,891 | 2/1981 | Degen . | |
| 4,277,858 | 7/1981 | Bohme . | |
| 4,489,714 | 12/1984 | Barnes . | |
| 4,569,339 | 2/1986 | Barnes . | |
| 4,649,905 | 3/1987 | Barnes . | |
| 4,669,136 | 6/1987 | Waters et al. . | |
| 4,724,828 | 2/1988 | Barnes et al. . | |
| 4,774,732 | 10/1988 | Riedl . | |
| 4,809,685 | 3/1989 | Barnes . | |
| 4,821,351 | 4/1989 | Bergenwall . | |
| 4,862,529 | 9/1989 | Peck . | |
| 4,935,968 | 6/1990 | Hunt et al. . | |
| 4,935,974 | 6/1990 | Stebbins et al. . | |
| 4,936,554 | 6/1990 | Heyward . | |

FOREIGN PATENT DOCUMENTS

| | | | |
|---|---|---|---|
| 644700 | 7/1982 | Canada | 5/69 |
| 2811409 | 9/1979 | Fed. Rep. of Germany | 5/66 |
| 2913712 | 10/1980 | Fed. Rep. of Germany | 5/66 |
| 152278 | 11/1955 | Sweden | 5/66 |
| 556794 | 10/1942 | United Kingdom | 5/60 |
| 1230459 | 5/1971 | United Kingdom | 5/62 |
| 1514282 | 6/1978 | United Kingdom | 5/62 |

OTHER PUBLICATIONS

Catalog brochure "Akron M6M Couch".
Brochure "The Anniversary Bed Brings Low Maintenance for the Engineer".
Brochure "Muller Betten".
Brochure "Arnold Medical-Furniture".
Stegelmeyer GmbH & Co. brochure.

*Primary Examiner*—Michael F. Trettel
*Attorney, Agent, or Firm*—Price, Heneveld, Cooper, DeWitt & Litton

[57] ABSTRACT

An adjustable care bed includes a base frame which supports a mattress frame. The mattress frame includes a head section, a seat or intermediate section and a foot or leg section all of which are pivotally interconnected. A first link and positioner subassembly interconnects the head section with the seat section. A second link and positioner subassembly interconnects the seat section with the leg or foot section. Each link and positioner subassembly includes a link fixed to one of the sections and having a free end. A bracket is fixed to the intermediate section. An elongated rod has an end pivoted to the bracket and a free end which extends through a lock housing. The lock housing is pivoted to the free end of the fixed link. A lock mechanism selectively locks or positions the rod with respect to the lock housing. The bed further includes an extendable caster subassembly, and a hi/low mechanism for raising the mattress frame with respect to the base frame, and a leg lift mechanism.

22 Claims, 6 Drawing Sheets

ADJUSTABLE BED

BACKGROUND OF THE INVENTION

The present invention relates to beds, and more particularly to an adjustable multi-position care bed.

A wide variety of adjustable, multi-position beds are presently available. Such beds may be used in hospitals, nursing homes and other care facilities. A typical hospital bed includes a mattress frame divided into a plurality of sections. The frame may include a head section, a seat section and leg or foot section. The sections are positionable so that the patient may be moved from a flat resting position to a raised, seating position wherein the back is moved upwardly and the legs may be bent. Typically the sections are positioned by a motor drive or by hand operated cranks. Hand cranks present inherent problems relating to ease of use. The cranks generally are in awkward positions and use is fatiguing. The cranks are difficult to store to prevent accidents while still being functional.

In nursing homes, rest homes and other long-term or extended care facilities, multi-position beds are desirable. The costs and complexity associated with motor driven or crank operated beds may, however, be considered excessive. In addition, it is desirable in such areas to provide a bed which may be operated manually by the occupant while on the bed. The advantages of an adjustable bed may also be desirable in the residential environment for home care use and general use. Again, cost, complexity and difficulties with use prevent realization of such benefits in the home market.

Examples of prior multi-position beds ma be found in U.S. Pat. No. 3,132,351 entitled Hospital Bed and which issued on May 12, 1964 to Huntress et al., U.S. Pat. No. 3,230,554 entitled Motion Regulator and which issued on Jan. 25, 1966 to the present inventor and U.S. Pat. No. 3,530,514 entitled Adjustable Beds and issued on Sep. 29, 1970 to McCalley. The bed of U.S. Pat. No. 3,230,554 includes a head section, an intermediate section and a leg or foot section. The weight of the occupant may be used to raise and lower the bed or change relative positioning of the bed sections. The sections are secured to a frame through a bracket and floating links. A motion regulator is connected to the head section. The motion regulator includes a threaded shaft, a tube and a brake assembly. An actuating mechanism is provided for releasing the brake assembly.

Other beds such as that disclosed in U.S. Pat. No. 3,353,193 entitled Self-Adjusting Bed and issued on Nov. 21, 1967 to Greiner are also self-adjusting and are actuated by the patient's weight. In the Greiner structure, a head section is pivoted to a leg or lower section. Relative positioning between the sections is controlled by a bow-shaped member or lock bar.

A need exists for a relatively simple, reliable and easy-to-use adjustable bed having multiple sections and which may be positioned by the occupant.

SUMMARY OF THE INVENTION

In accordance with the present invention, the aforementioned need is fulfilled. Essentially, the bed includes a base frame and a mattress frame. The mattress frame includes a head section and a lower section. Provision is made for mounting the mattress frame on the base frame. A positioner means interconnects the head section and the lower section for positioning and the angular relationship of the sections. The positioner means includes a rigid link having an end fixed to the head section of the free end, a bracket fixed to the lower section, and an elongated rod having an end pivoted to the bracket and a free end. A lock means pivoted to the free end of the rigid link receives the rod free end and selectively locks the rod with respect to the rigid link.

In narrower aspects of the invention, the mattress frame's lower section includes an intermediate or seat section pivoted to a leg or foot section. Another positioner means interconnects the foot section with the intermediate section. The occupant may, therefore, raise the back section or head section with respect to the seat and lower the foot section with respect to the seat section in a "knee break" type action. A hi/low mechanism may be included for raising and lowering the mattress frame with respect to the base frame. A retractable caster subassembly may be included to increase the ease of positioning the bed. Further, a leg or lower section lift mechanism may be included.

DETAILED DESCRIPTION OF THE PREFERRED EMBODIMENT

Figure 1:
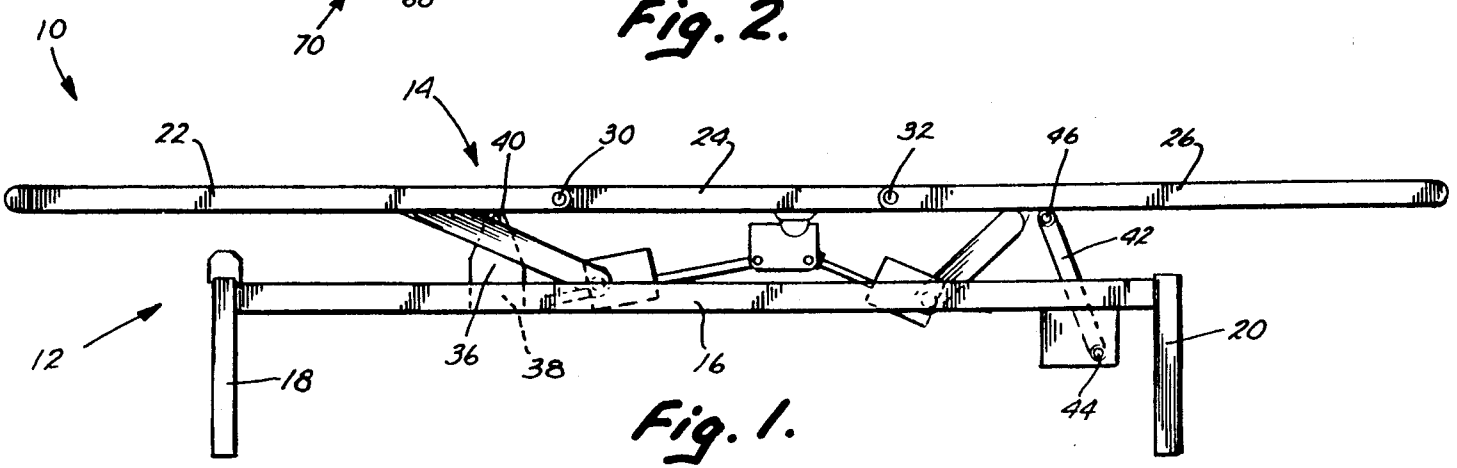
FIG. 1 is a side, elevational view of a bed in accordance with the present invention.

An adjustable bed in accordance with the present invention is illustrated in FIG. 1 and generally designated by the numeral 10. Bed 10 includes a base or subframe 12 and a mattress frame 14. Frame 12 includes elongated side members 16, a pair of legs 18 at a head portion of the frame and a pair of legs 20 at a foot portion or lower end of the frame. In the embodiment shown, mattress frame 14 includes a head or back section 22, a seat or intermediate section 24 and a foot or leg section 26. Section 22 is pivoted to section 24 at a pivot 30. Section 24 is also pivoted to section 26 at a pivot 32. In the embodiment illustrated in FIG. 1, a mount secures frame 14 on subframe 12. As shown, the mount includes a support link 36 having a lower end 38 fixed to base frame 12 and an upper end 40 pivoted to head section 22. Another support link 42 includes a lower end 44 pivoted to base frame 12 and an upper end 46 pivoted to leg section 26 of the lower section of mattress 14.

Figure 2:
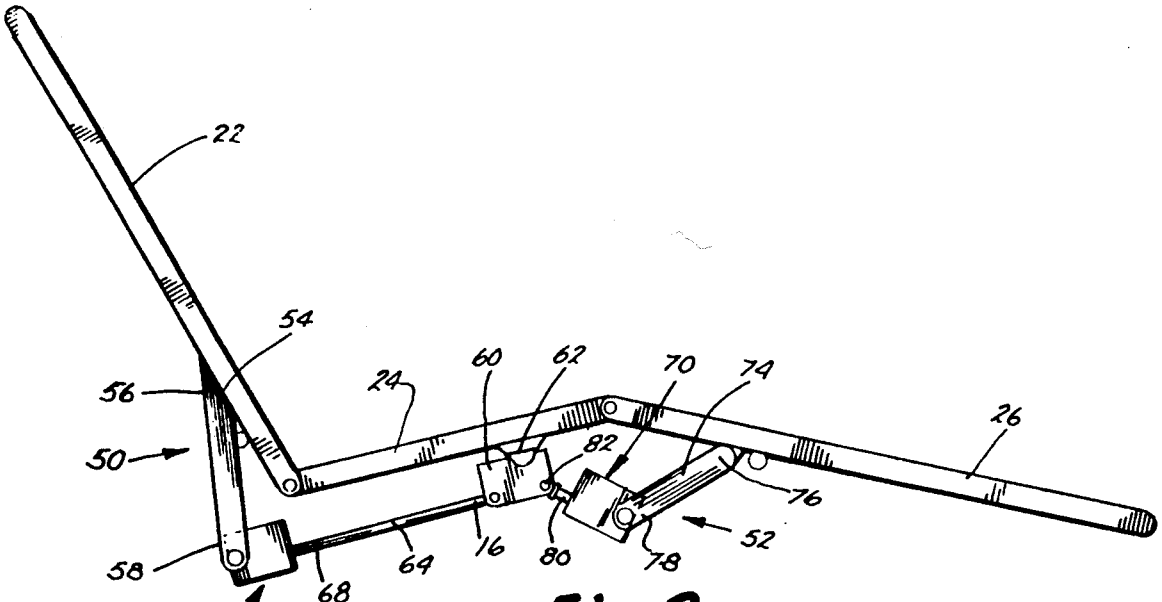
FIG. 2 is a side, elevational view of a portion of the bed of FIG. 1 showing the mattress frame in a contoured position.
Figure 5:
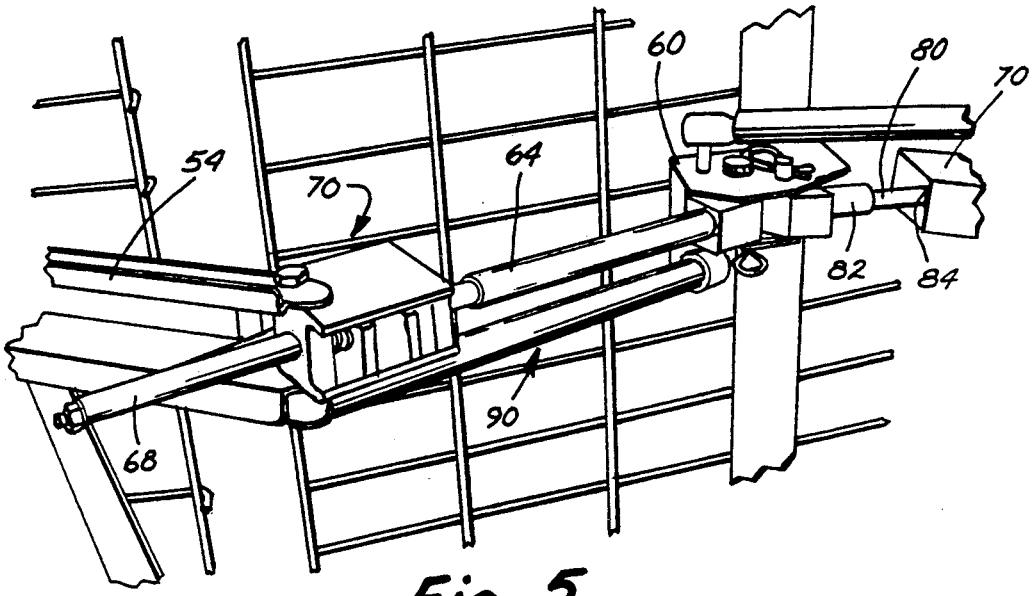
FIG. 5 is a fragmentary, perspective view showing a linear positioner incorporated in the present invention.

The mattress frame sections may be moved from the flat configuration shown in FIG. 1 to a contoured configuration shown in FIG. 2 wherein head section 22 is angled or tilted with respect to the base frame and the intermediate section 24 and wherein sections 24 and 26 are angularly related to form a "knee break". Relative positioning of the sections with respect to each other is provided by link and positioner subassemblies 50, 52. As seen in FIGS. 1, 2 and 5, subassembly 50 includes a first fixed link or strut 54 having an end 56 rigidly fixed to head section 22. Strut 54 defines a free end 58. A bracket 60 is fixed at an upper end 62 thereof to intermediate section 24. A linear positioner includes an elongated rod 64. Rod 64 includes an end 66 pivoted to bracket 60 and a free end 68. End 68 extends through a lock mechanism 70.

Subassembly 52 includes a fixed link or support strut 74 having an end 76 fixed to leg or foot section 26 and a free end 78. An elongated positioner rod 80 has an end 82 pivoted to bracket 60, a free end 84 of rod 80 extends into a lock mechanism 70. In the preferred embodiment as shown in FIG. 5, for example, a gas spring or hydraulic damper 90 extends between bracket 60 and each support strut 54, 74. Dampers 90 control the movement of the bed sections. As shown in FIGS. 1 and 2, therefore, head section 22, intermediate section 24 and the lock and positioner subassemblies define a three-bar linkage. The first link includes head section 22 and fixed strut 54. The second link includes intermediate section 24 and the third link includes the linear positioner. The elongated rod 64 gives the third link a variable length.

Figure 6:
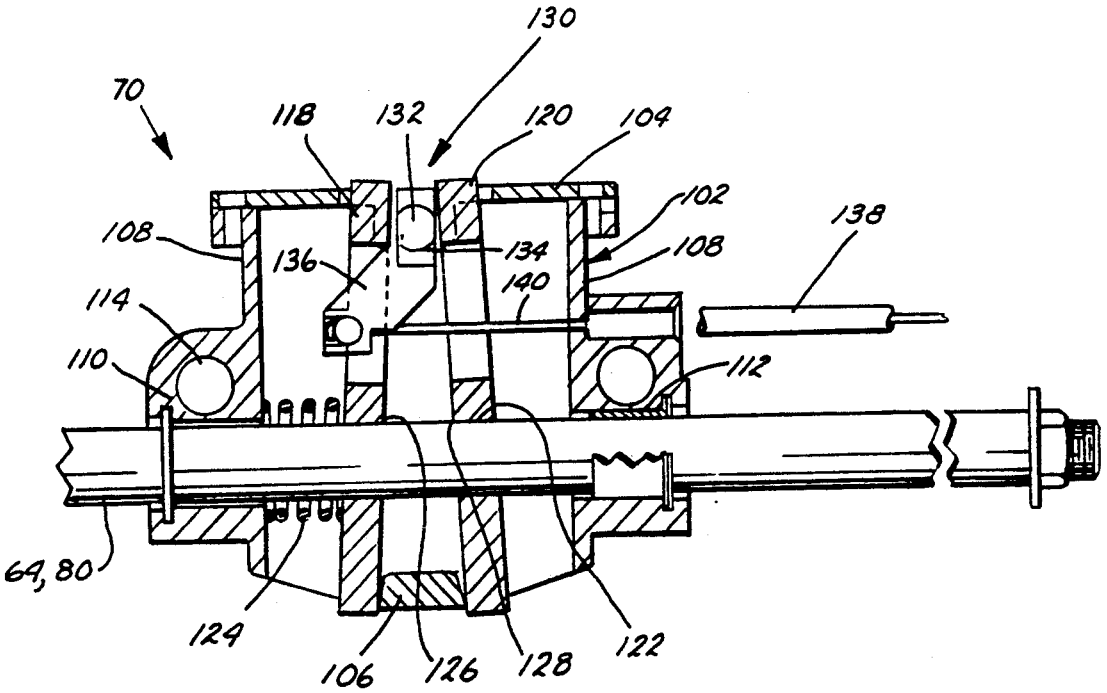
FIG. 6 is a fragmentary, side elevational view in partial cross section of a lock mechanism incorporated in the positioner.

As shown in FIG. 6, lock 70 includes a housing structure 102 having a cover 104 and a cross piece 106. Sides 108 of housing 102 define aligned apertures 110, 112. The respective lock rods 64, 80 extend through apertures 110, 112. Housing 102 defines a pivot aperture 114 which permits the housing to be pivoted to its respective support link.

Positioned within housing 102 are a pair of lock plates 118, 120. Each lock plate defines a lock aperture 122. Plates 118, 120 pivot with respect to each other above cross piece 106. Plates 118, 120 are biased to the position shown in FIG. 6 by coil springs 124. When in the position shown, edges 126, 128 of apertures 122 engage the positioner rod. The rod is locked and held with respect to housing 102.

A cam mechanism 130 is provided to move the lock plates 118, 120 away from each other and hence to release the rod. Cam mechanism 130 includes a pivot 132, a cam portion 134 and a lever 136. A Bowden cable including an outer sheath or housing 138 and a cable 140 rotates cam 130. Cable 140 is routed to a convenient position on the mattress frame so as to permit operation by the occupant.

Figure 6A:
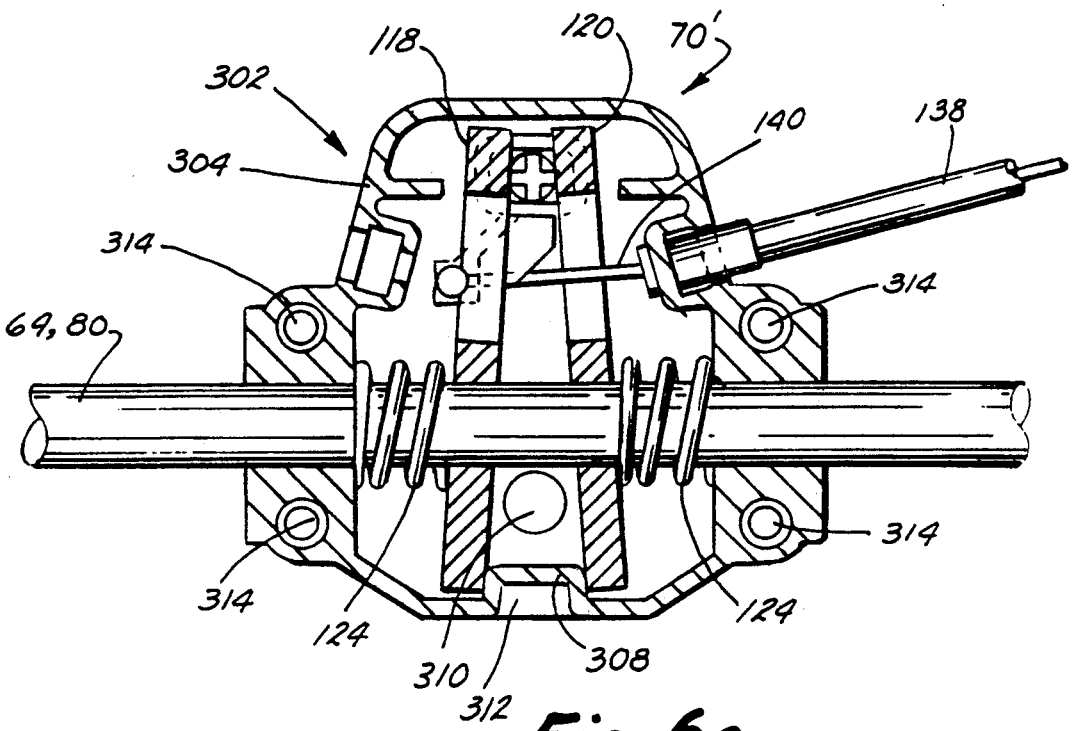
FIG. 6*a* is a fragmentary, side elevational view in partial cross section of an alternative lock mechanism.

FIG. 6*a* illustrates an alternative and presently preferred lock mechanism designated 70'. Mechanism 70' also includes plates 118, 120, springs 124, cam mechanism 130, cable housing 138, and cable 140. Mechanism 70'. however, includes a two piece, clam shell housing 302. Housing 302 is split vertically into two mirror image halves 304. Each half 304 forms sockets 306 for receipt of cable housing 138. The halves form a lower web or cross piece 308 about which plates 118, 120 pivot. The halves define a pivot aperture 310 located on the center line 312 of the housing. Housing halves 304 may be molded from an engineering plastic and assembled by fasteners extending through apertures 314. This eliminates the separate cover of the embodiment of FIG. 6 and simplifies manufacture and assembly.

Changing of the angular position of the bed sections is easily accomplished. Should the occupant desire to move towards an upright position with the seat back raised with respect to the intermediate or seat section 24, the cable actuator is pulled which rotates the cam to release the lock plates of lock mechanism 70 which engages rod 64. The occupant's weight will cause seat section 24 to drop at its pivot 30 and head section 22 will tilt about pivot 40. Uncontrolled motion is prevented by damper 90. When the desired angular position is reached, cable 140 is released and plates 118, 120 engage lock rod 64. In a similar fashion, the angular position between leg section 26 and seat section 24 is also adjusted. Lock mechanism 70 engaging positioner rod 80 functions in precisely the same fashion as described above. Sections 24, 26 may be shifted to form the knee break configuration shown in FIG. 2. In the alternative, the lower section of the bed could be formed with a single elongated section. The seat and foot section would not be pivoted together. Subassembly 52 would, therefore, be eliminated. The resulting two section bed may be relatively inexpensively manufactured. The bed could be offered to the lower end market. The advantages of an adjustable bed may be readily realized in the home environment.

Figure 3:
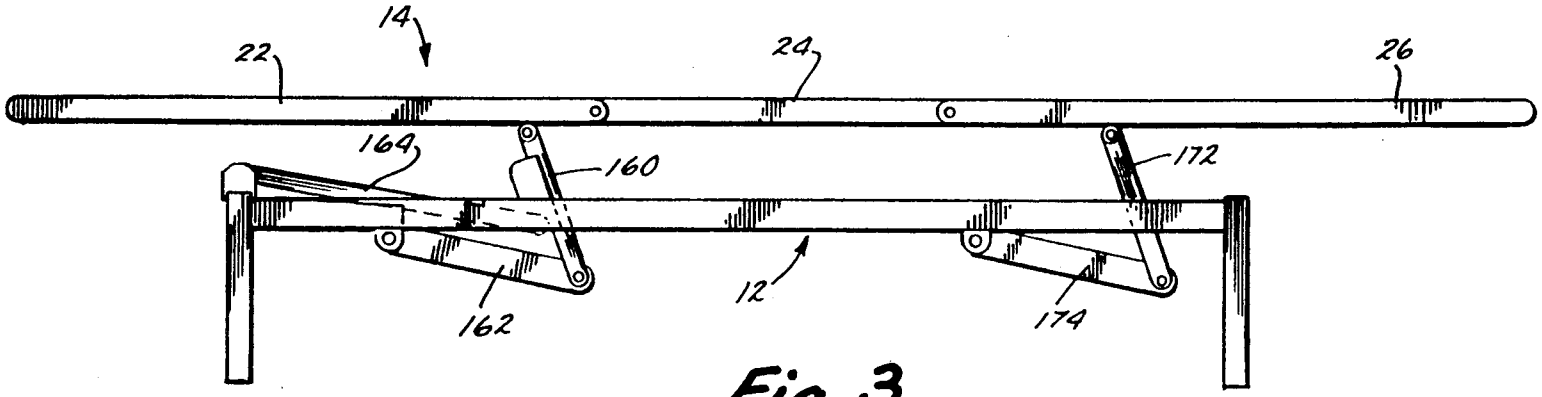
FIG. 3 is a side, elevational view of a portion of the bed in accordance with present invention including a hi/low mechanism.
Figure 4:
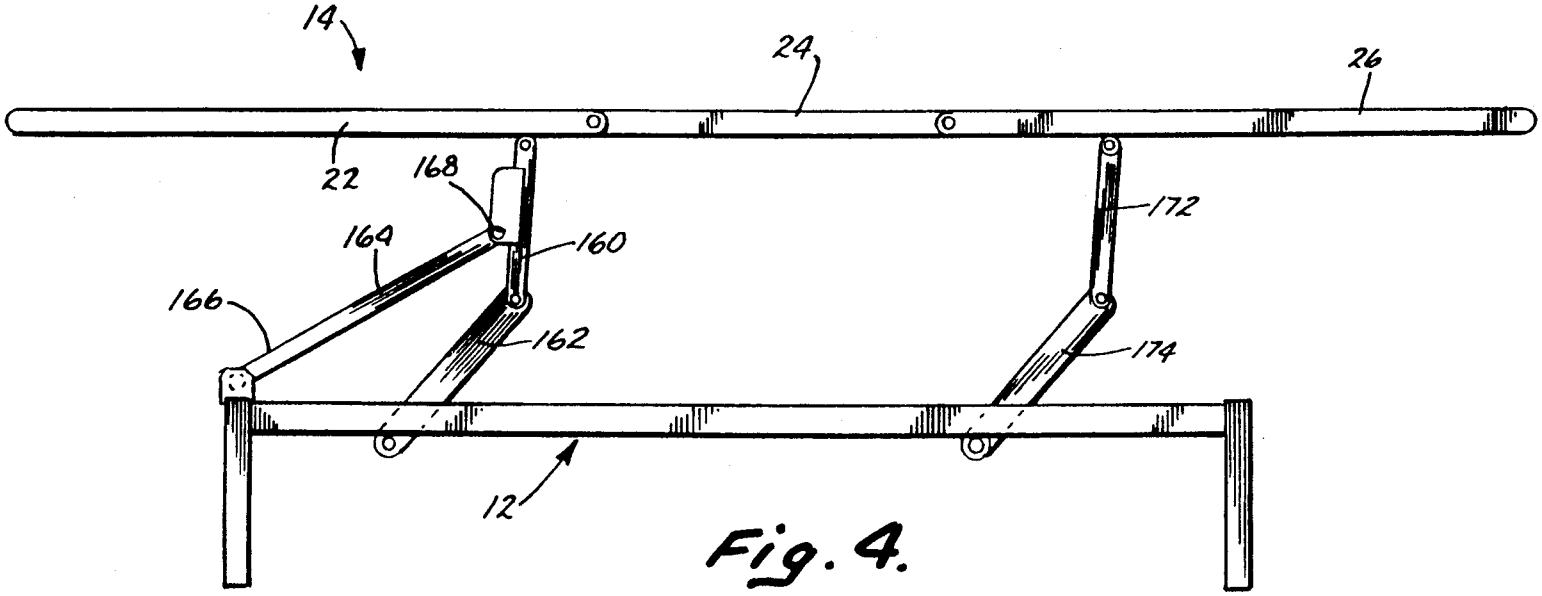
FIG. 4 is a side, elevational view of the bed shown in FIG. 3 showing the hi/low mechanism in the raised or elevated position.
Figure 9:
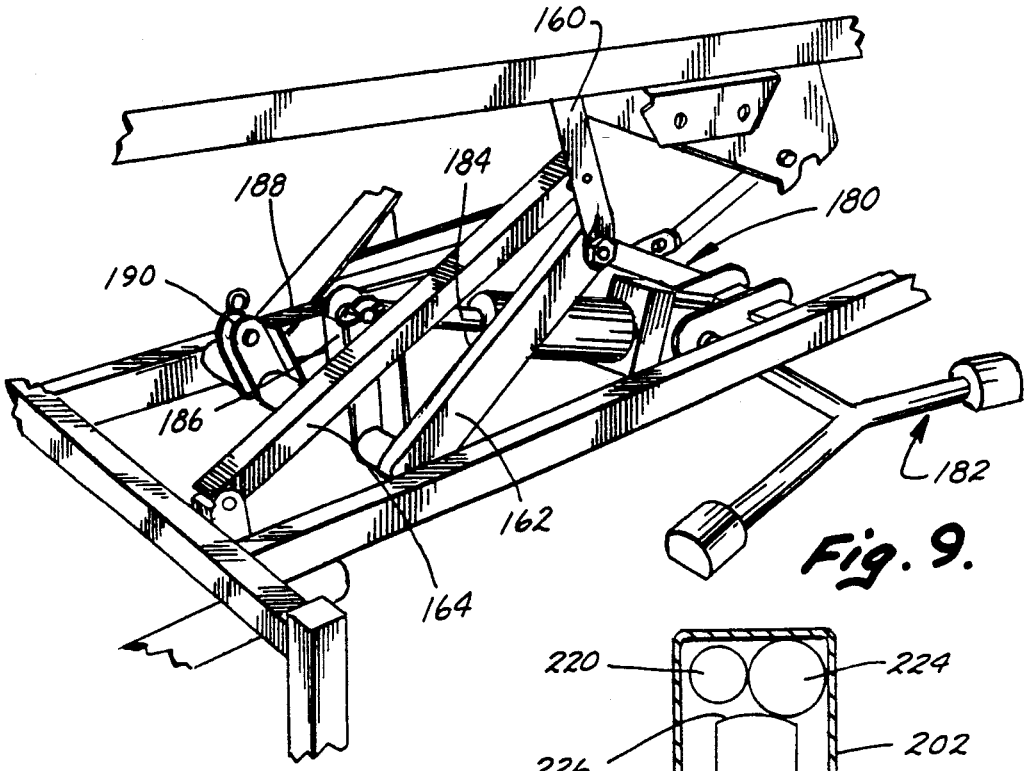
FIG. 9 is a fragmentary, perspective view showing a portion of the hi/low mechanism and elevating jack incorporated in the present invention.

In accordance with the present invention, a hi/low mechanism may also be included. The hi/low mechanism is illustrated in FIGS. 3, 4 and 9. As shown therein, a first pair of links 160, 162 connect head section 22 to base 12. A control link 164 has an end 166 pivoted to base 12 and another end 168 pivoted to link 160. A second pair of links 172, 174 are pivotally interconnected and pivoted to leg section 26 and base frame 12, respectively. Links 164, 160, 162 and the side rail of frame 12 define a four bar structure which causes frame 14 and upper end of link or strut 160 to travel in a straight line, vertical path.

As shown in FIGS. 3 and 4, pivotal motion of link 164 raises and lowers link pairs 160, 162, 172, 174 and hence shifts mattress frame 14 with respect to the base or subframe 12. As seen in FIG. 9, a jack 180 may be provided to raise and lower the link pairs. Jack 180 may be a hydraulic or mechanical jack operated by foot pedal 182. In the embodiment shown, jack 180 is a hydraulic unit including a piston rod 184 pivoted to a strut 186. Strut 186 in turn is fixed to link 162 so that rotation of strut 186 rotates link 162. A control rod 188 extends from a link or strut 190. Strut 190 pivots with link 162. Rod 188 is connected at its opposite end to link 174.

Figure 7:
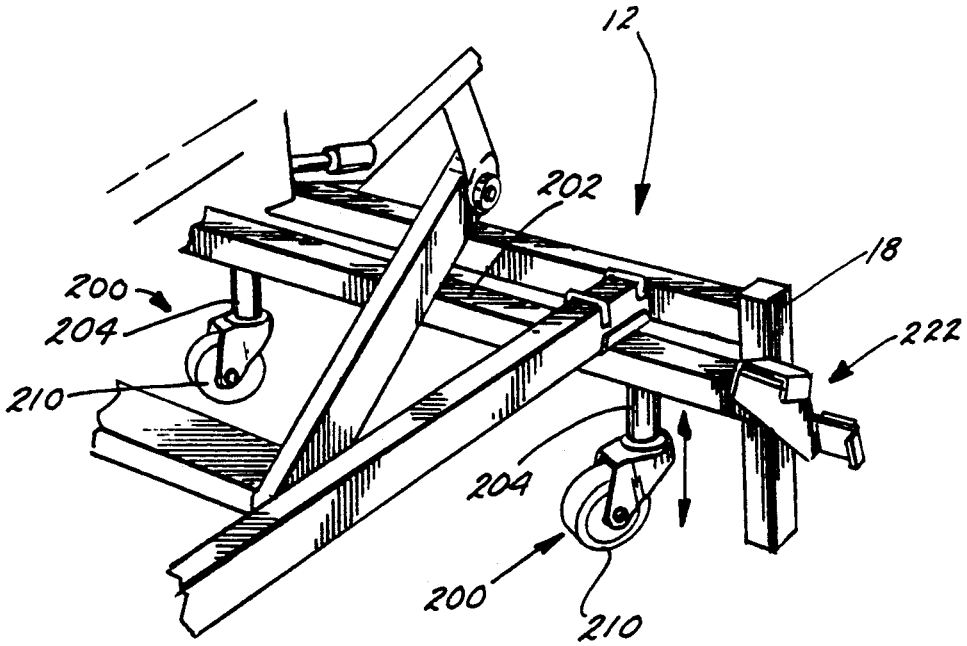
FIG. 7 is a fragmentary, perspective view of a portion of the bed showing the caster subassembly.
Figure 8:
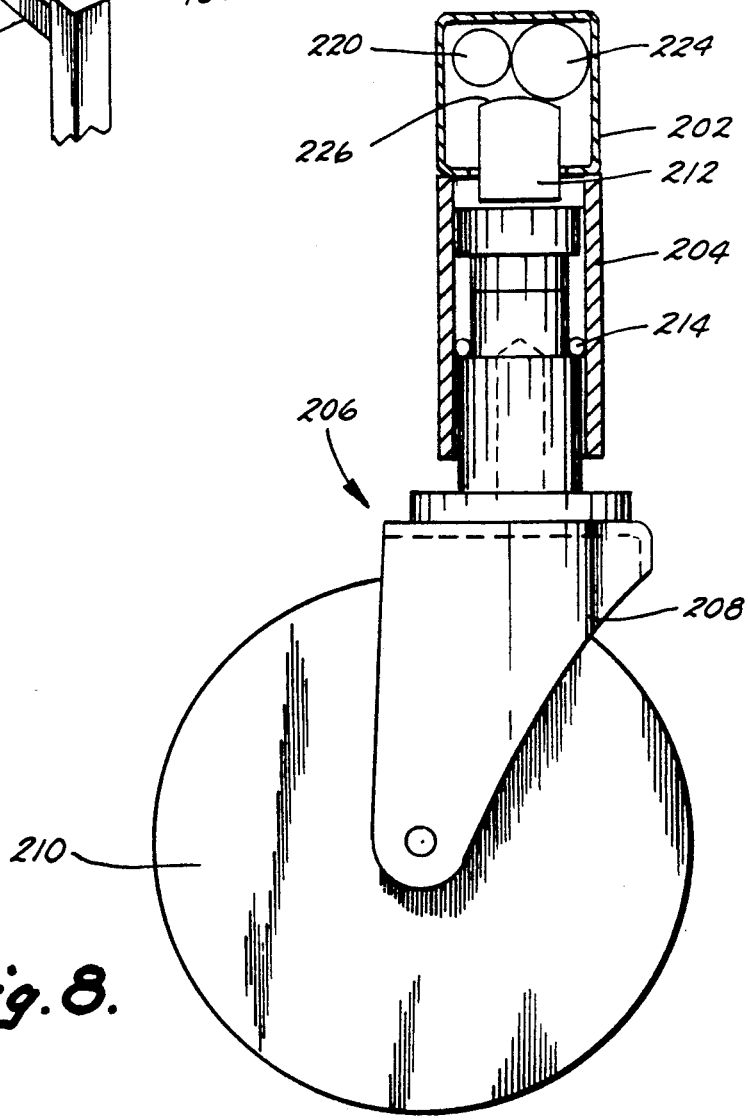
FIG. 8 is a side, elevational view and partial section of the caster subassembly.

A caster subassembly, illustrated in FIGS. 7 and 8, is provided to increase the ease of positioning of the bed. As shown, a pair of casters 200 are supported on subframe 12. Frame 12 includes a transverse cross piece or tube 202. Extending downwardly from tube 202 are a pair of vertical tubes 204. A caster wheel 206 includes a caster bracket 208, a wheel 210 and a caster stem 212. Stem 212 is positioned within tube 204. A garter spring or ring 214 prevents the stem from falling out of the tube. Normally the bed is supported on legs 20 of base 12 on the floor. A cam arrangement is provided for lowering wheels 210 into engagement with the floor and lifting legs 20. As shown in FIG. 8, the cam includes an elongated shaft 220. Shaft 220 rotates within tube 202 and is shifted by a foot pedal 222. A cam 224 is non rotatably fixed to shaft 220. Rotation of pedal 222 in a clockwise direction when viewed in FIG. 7, rotates cam 224 downwardly onto a follower surface 226 defined by stem 212. This moves stem 212 downwardly and hence forces wheel 210 into engagement with the floor raising the legs 20. An overcenter action is provided with the cams so that when the stems are fully extended, the foot pedal must be actuated to release the casters so that they may be retracted into the tubes 204. When it is desired to move the bed, foot pedal 222 is actuated to lower the cam wheels 210. The bed may, therefore, be grasped at one end and easily positioned or pushed along the floor.

Figure 10:
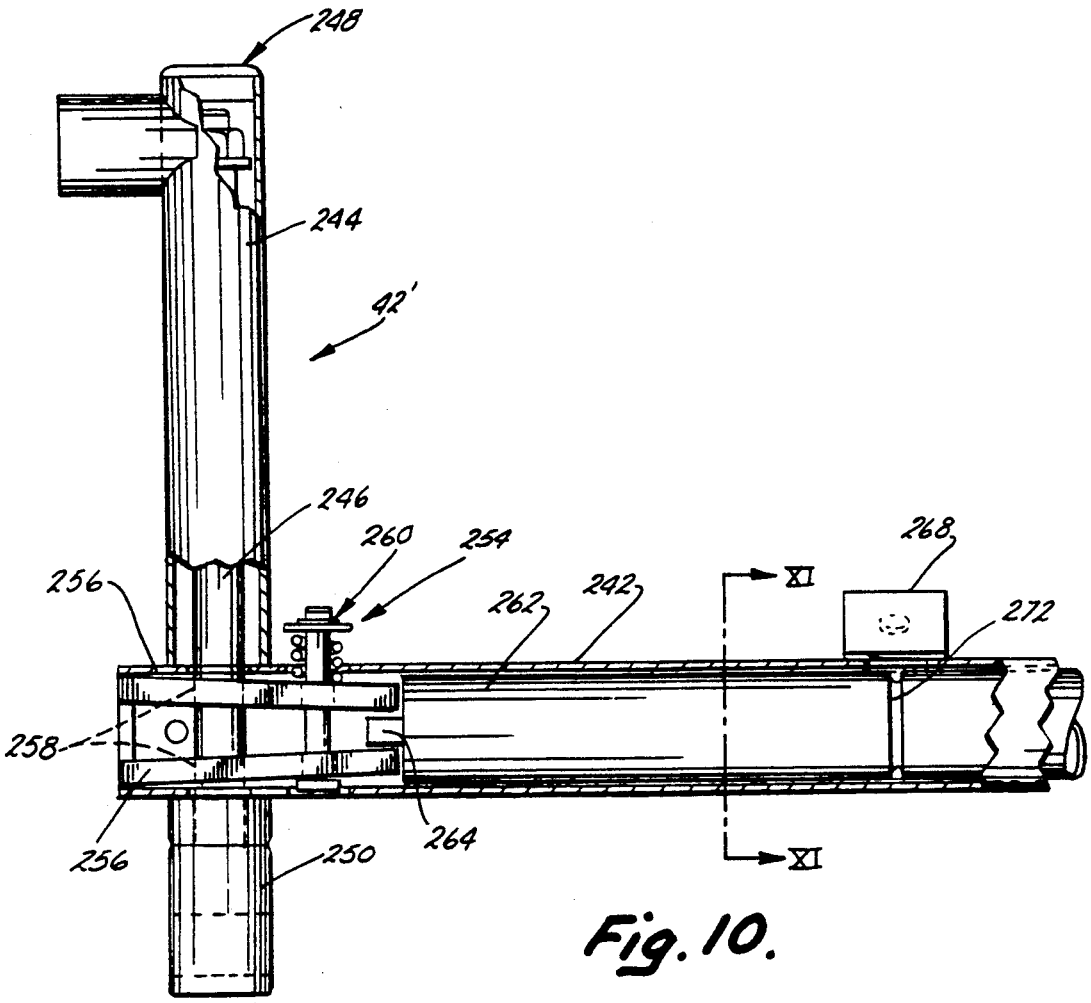
FIG. 10 is a fragmentary, elevational view in partial section of a leg lift mechanism incorporated in the present invention.
Figure 11:
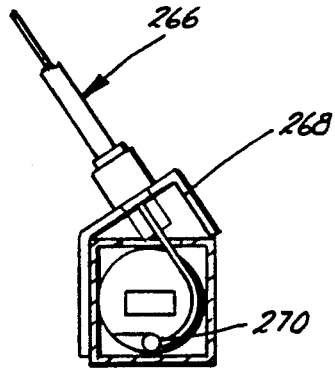
FIG. 11 is a cross-sectional view taken along lines XI—XI of FIG. 10.

A leg lift mechanism 240 is shown in FIGS. 10 and 11. Mechanism 240 is substituted for links 42 or 172 and allows frame 14 to be tilted upwardly about pivot 40. Mechanism 240 includes a pair of links 42' at each end of an elongated tube 242. Mechanism 240 is symmetrical about a center axis and only one-half of the device is shown.

Link 42' has an outer tube or cylinder 244 and an extensible shaft 246. Lower end 248 of tube 244 is attached to frame 12 at pivot 44. Shaft 246 carries a bushing 250 which attaches to frame 14 at pivot 46. Extension and retraction of shaft 246 causes frame 14 to pivot about pivot 40. The length of link 42' is controlled by a lock mechanism 254 within tube 242. Lock mechanism 254 includes a pair of pivotable lock plates 256. Plates 256 define lock apertures 258 having edges engageable with rod or shaft 246. A spring means 260 biases the plates into a lock position. A cam bar 262 is rotatable within tube 242. Bar 262 includes cams 264 at each end. A cable assembly 266 has an end mounted on a bracket 268. A cable end 270 rides in a groove 272 of bar 262 and is keyed to the bar. The opposite end of the cable is routed to the lower end of the bed. Pulling on the cable rotates bar 262 causing cams 264 to move plates 256 apart. Shafts 246 ar released and links 42' may be extended. Bar 262 and cable assembly 266 cause simultaneous release of the right and left lock mechanisms and hence, shafts 246.

In view of the above description, those of ordinary skill in the art may envision various modifications which would not depart from the inventive concepts disclosed. It is expressly intended, therefore, that the above should be considered only as a description of the preferred embodiment. The true spirit and scope of the present invention may be determined by referenced to the appended claims.

The embodiments of the invention in which an exclusive property or privilege is claimed are defined as follows:

1. An adjustable bed, said bed comprising:

a base frame defining a head end and a foot end, said frame including a pair of legs at the head end and a pair of legs at the foot end;

a mattress frame including a head section and a lower section pivoted to said head section;

mounting means on the base frame for mounting the mattress frame to said base frame and for permitting the head section to tilt with respect to said base frame and said lower section; and positioner means interconnecting said head section and said lower section for positioning and locking the angular relationship of said sections, said positioner means including:

a first link having an end fixed to said head section and a free end;

a bracket fixed to said lower section;

an elongated rod having an end pivoted to said bracket and a free end;

lock means pivoted to said free end of said first link for locking said rod free end with respect to said first link and hence said head section with respect to said lower section; and a caster subassembly at an end of said base frame, said subassembly including a caster wheel and cam means for lowering said caster wheel into engagement with a floor, and wherein said cam means comprises:

an elongated shaft rotatably mounted on said base frame;

a foot pedal fixed to said shaft; and a cam fixed to said shaft and positioned to engage said caster wheel.

2. A bed as defined by claim 1 wherein said lock means comprises:

a housing defining a pair of opposed apertures through which said rod extends;

a pair of lock plates disposed within said housing, each plate defining a lock aperture through which said rod extends;

spring means within said housing for urging an edge of each of said lock apertures into engagement with said rod; and cam means engaging said lock plates for moving the lock aperture edges out of engagement with said rod so that said rod free end may move with respect to said housing and said first link.

3. A bed as defined by claim 2 wherein said mounting means comprises:

a first support link having a lower end fixed to said base frame and an upper end pivoted to said head section; and a second support link having an end pivoted to said lower section and an end pivoted to said base frame.

4. A bed as defined by claim 2 wherein mounting means comprises a hi/low mechanism for raising and lowering said mattress frame with respect to said base frame.

5. A bed as defined by claim 2 wherein said positioner means further includes damper means between said bracket and said first link for controlling tilting of said sections.

6. A bed as defined by claim 1 wherein said mattress frame lower section includes an intermediate section pivoted at one end to said head section and a leg section pivoted to said intermediate section, and wherein said bed further includes another positioner means interconnecting said intermediate section and said leg section for permitting selective positioning of said leg section with respect to said intermediate section.

7. A bed as defined by claim 6 wherein said another positioner comprises:

a second link having an end fixed to said leg section and a free end;

another elongated rod having an end pivoted to said bracket and a free end; and another lock means pivoted to said free end of said second link for locking said another rod free end with respect to said second lock.

8. An adjustable bed, said bed comprising:
a base frame defining a head end and a foot end, said frame including a pair of legs at the head end and a pair of legs at the foot end;
a mattress frame including a head section and a lower section pivoted to said head section;
mounting means on the base frame for mounting the mattress frame to said base frame and for permitting the head section to tilt with respect to said base frame and said lower section; and
positioner means interconnecting said head section and said lower section for positioning and locking the angular relationship of said sections, said positioner means including:
a first link having an end fixed to said head section and a free end;
a bracket fixed to said lower section;
an elongated rod having an end pivoted to said bracket and a free end;
lock means pivoted to said free end of said first link for locking said rod free end with respect to said first link and hence said head section with respect to said lower section, and wherein said mounting means comprises:
a first support link having a lower end connected to said base frame and an upper end pivoted to said head section; and
a leg lift means pivoted to said base frame and said lower section of said mattress frame for permitting said mattress frame to be tilted about the pivot of said first support link.

9. A bed as defined by claim 8 wherein said leg lift means comprises:
a tube link;
a lift shaft telescopingly disposed within said tube, said tube and said shaft each being pivoted to one of said mattress frame and said base frame; and
lift shaft lock means engaging said lift shaft for locking the position of said left shaft with respect to said tube link.

10. A bed as defined by claim 9 wherein said lift shaft lock means comprises:
a pair of shaft lock plates, each defining an aperture having edge engageable with said lift shaft;
spring means for biasing the shaft lock plate edges into engagement with the lift shaft; and
cam means for moving said shaft lock plate edges out of engagement with said lift shaft.

11. A bed as defined by claim 8 wherein said lock means comprises:
a housing defining a pair of opposed apertures through which said rod extends;
a pair of lock plates disposed within said housing, each plate defining a lock aperture through which said rod extends;
spring means within said housing for urging an edge of each of said lock apertures into engagement with said rod; and
cam means engaging said lock plates for moving the lock aperture edges out of engagement with said rod so that said rod free end may move with respect to said housing and said first link.

12. A bed as defined by claim 11 wherein said positioner means further includes damper means between said bracket and said first link for controlling tilting of said 13. An adjustable bed, comprising:
a base frame;
a mattress frame having a head section and a foot section;
a support link having a lower end connected to the base frame and an upper end pivoted to the head section of said mattress frame; and
leg lift means between the base frame and the mattress frame for permitting said mattress frame to be tilted about the upper end of said support link, said leg lift means comprising:
an elongated tubular member having ends;
a pair of telescoping links, each adjacent one of said ends of said member, said links each including an outer tube and a lift shaft telescopingly disposed within said tube, said tubes and said shafts being pivoted to one of said mattress frame and said base frame;
lift shaft lock means within said elongated tubular member for engaging said lift shafts for simultaneously locking the positions of said lift shafts with respect to said outer tube and said elongated tubular member and for simultaneously releasing said lift shafts so that the effective length of said links may be adjusted.

14. An adjustable bed as defined by claim 13 wherein said lift shaft lock means comprises:
two pairs of lock plates, each pair being at one end of said tubular member, said pairs of lock plates each defining lock apertures through which one of said lift shafts extend;
a pair of springs, each spring engaging one of said pairs of lock plates; and
an elongated lift rod rotatably disposed within said elongated member, said lift rod having a cam at each end, said cams each being engagable with one of said pairs of lock plates to move said plates out of engagement with a respective one of said lift shafts.

15. An adjustable bed as defined by claim 14 further including:
a cable assembly having a housing engaging said elongated tubular member and a cable wrapped around said elongated lift rod for rotating said lift rod.

16. An adjustable bed as defined by claim 13 wherein said head section and said foot section of said mattress frame are pivotally interconnected.

17. An adjustable bed as defined by claim 16 further including:
positioner means interconnecting said head section and said foot section for positioning and locking the angular relationship of said sections.

18. An adjustable bed as defined by claim 17 wherein said positioner means comprises:
a first link having an end fixed to said head section and a free end;
an elongated rod having an end pivoted to said foot section and a free end;
rod lock means pivoted to said free end of said first link for locking said rod free end with respect to said first link and hence said head section with respect to said foot section.

19. An adjustable bed as defined by claim 18 wherein said rod lock means comprises:
a housing defining a pair of opposed apertures through which said rod extends;
a pair of lock plates disposed within said housing, each plate defining a lock aperture through which said rod extends;

spring means within said housing for urging an edge of each of said lock apertures into engagement with said rod; and cam means engaging said lock plates for moving the lock aperture edges out of engagement with said rod so that said rod free end may move with respect to said housing and said first link.

20. An adjustable bed as defined by claim 19 wherein said lift shaft lock means comprises:

two pairs of lock plates, each pair being at one end of said tubular member, said pairs of lock plates each defining lock apertures through which one of said lift shafts extend;

a pair of springs, each spring engaging one of said pairs of lock plates; and an elongated lift rod rotatably disposed within said elongated member, said lift rod having a cam at each end, said cams each being engagable with one of said pairs of lock plates to move said plates out of engagement with a respective one of said lift shafts.

21. An adjustable bed as defined by claim 20 further including:

a cable assembly having a housing engaging said elongated tubular member and a cable wrapped around said elongated lift rod for rotating said lift rod.

22. An adjustable bed as defined by claim 21 further comprising:

a hi/low mechanism for raising and lowering said mattress frame with respect to said base frame.

* * * * *

UNITED STATES PATENT AND TRADEMARK OFFICE

CERTIFICATE OF CORRECTION

PATENT NO. : 5,105,486

DATED : April 21, 1992

INVENTOR(S) : Warren J. Peterson

It is certified that error appears in the above-identified patent and that said Letters Patent is hereby corrected as shown below:

Column 1, line 33;

"ma" should be --may--.

Column 3, line 6;

after "mattress" insert --frame--.

Column 3, line 65;

"70'." should be --70',--.

Column 5, line 42;

"ar" should be --are--.

Column 5, line 52;

"referenced" should be --reference--.

Column 7, line 39, Claim 9;

"left" should be --lift--.

Column 7, line 66, Claim 12;

after "said" insert --sections.--.

Signed and Sealed this

Twenty-eighth Day of September, 1993

*Attest:*

*Attesting Officer*

BRUCE LEHMAN

*Commissioner of Patents and Trademarks*